US009562753B2

(12) United States Patent
Stock, Jr. et al.

(10) Patent No.: US 9,562,753 B2
(45) Date of Patent: Feb. 7, 2017

(54) UPSET JACKETED BULLETS

(75) Inventors: Michael Eugene Stock, Jr., Maryville, IL (US); Gerald Todd Eberhart, Bethalto, IL (US)

(73) Assignee: OLIN CORPORATION, East Alton, IL (US)

( * ) Notice: Subject to any disclaimer, the term of this patent is extended or adjusted under 35 U.S.C. 154(b) by 3228 days.

(21) Appl. No.: 11/512,486

(22) Filed: Aug. 30, 2006

(65) Prior Publication Data

US 2007/0131131 A1 Jun. 14, 2007

Related U.S. Application Data

(63) Continuation-in-part of application No. 11/011,318, filed on Dec. 13, 2004, now abandoned.

(51) Int. Cl.
*F42B 12/34* (2006.01)

(52) U.S. Cl.
CPC ..... *F42B 12/34* (2013.01)

(58) Field of Classification Search
CPC ..... F42B 12/34
USPC ..... 102/507, 508, 509, 510
See application file for complete search history.

(56) References Cited

U.S. PATENT DOCUMENTS

| | | | | |
|---|---|---|---|---|
| 3,003,420 | A * | 10/1961 | Nosler | 102/508 |
| 4,685,397 | A | 8/1987 | Schirneker | 102/510 |
| 5,101,732 | A | 4/1992 | Schluckebier | |
| 5,127,332 | A | 7/1992 | Corzine et al. | |
| 5,208,424 | A | 5/1993 | Schluckebier et al. | |
| 5,333,552 | A * | 8/1994 | Corzine et al. | 102/509 |
| 5,385,100 | A | 1/1995 | Corzine et al. | |
| 5,385,101 | A | 1/1995 | Corzine et al. | |
| 6,176,186 | B1 * | 1/2001 | Engel | 102/510 |
| 6,837,165 | B2 | 1/2005 | Eberhart et al. | |
| 6,964,232 | B2 | 11/2005 | Eberhart et al. | |
| 2005/0066845 | A1 | 3/2005 | Eberhart et al. | |
| 2006/0124022 | A1 | 6/2006 | Eberhart et al. | |

OTHER PUBLICATIONS http://www.hornady.com/media/2006catalog/Hornady_Bullets_Rifle_Vmax.pdf#search=%22hornady%20V-max%20tip%22; 2 pages.

International Search Report and Written Opinion for corresponding PCT/US07/77317 Date: Sep. 11, 2008 pp. 8.

* cited by examiner

*Primary Examiner* — Stephen M Johnson
(74) *Attorney, Agent, or Firm* — Harness, Dickey & Pierce, P.L.C.

(57) ABSTRACT

A projectile according to exemplary embodiments generally includes a jacket with nose, middle, and heel portions. The nose portion includes a forward cavity. The heel portion includes a rearward cavity having sidewalls. A dense core is within the rearward cavity and bonded to the sidewalls. Upon upset of the projectile, the portion of the jacket forming the forward cavity peels generally back toward the heel portion thereby forming petals, and the sidewalls and the dense core axially compress and radially expand to define a bulge portion, with the jacket material substantially covering the dense core material thereby inhibiting exposure of the dense core material to the upset media.

2 Claims, 10 Drawing Sheets

UPSET JACKETED BULLETS

CROSS-REFERENCE TO RELATED APPLICATION

This application is a continuation-in-part of U.S. patent application Ser. No. 11/011,318 filed Dec. 13, 2004, now abandoned, the disclosure of which is incorporated herein by reference.

FIELD

The present disclosure relates to jacketed bullets having bonded dense cores such that the bullet's upset configuration includes a bulge portion and jacket petals with the jacket material substantially covering the dense core material thereby inhibiting exposure of the dense core material to the upset media.

BACKGROUND

The statements in this section merely provide background information related to the present disclosure and may not constitute prior art.

Firearm projectiles used for hunting are generally small caliber, e.g., less than 0.50 caliber. Firearm projectiles commonly have a hollow point or soft metal nose portion to increase expansion of the projectile upon impact with animal tissue in order to achieve increased energy adsorption within the target animal's body. Many hunting projectiles, specifically lead-tipped or hollow point projectiles, have a significant drawback for use in hunting applications in that the projectiles tend to upset and expand greatly (even to the point of fragmentation), thus expending most of their energy and penetrating only a short distance. Accordingly, such projectiles are thus not particularly suitable for deep penetration. This is particularly true where the projectile hits a bone during passage into the animal. Hunters often aim for the shoulder area of the target animal in order to minimize (or at least reduce) the chance of the animal escaping after it has been shot. Plus, the animal's vital organs are usually in the same general area of the animal as the shoulder. As a result, it is not uncommon for the projectile to strike bone.

Projectile expansion is generally desirable for hunting to slow the projectile such that more energy is transferred to the target during passage through soft animal tissue. If the projectile does not expand significantly and does not hit a bone or vital organ, the projectile may pass through the animal without killing or stopping the animal. For the projectile to successfully pass through animal bone and still do damage to vital organs, it is usually necessary that the projectile have sufficient density, sufficient structural integrity, and retained weight.

Firearm projectiles used for hunting applications sometimes include unitary metal bodies with generally H-shaped longitudinal cross sections with an empty hollow point in front, and a rear cavity filled with a dense core formed from a material, such as lead. The rear cavity may be closed by a disk to seal the dense core from the environment. Because the rear cavity is filled with a dense core, the majority of the weight of this projectile is contained in the rear portion. As a result, this projectile has good weight retention because the projectile does not lose a significant part of its weight even when the petals in the front break off during penetration of the target.

This example projectile tends to bulge due to the forward inertia and kinetic energy of the heavy dense core during the rapid deceleration upon impact. Specifically, the forward portion of the sidewalls of the rear cavity of the projectile tends to bulge. This can be advantageous in that the bulge can help make a larger diameter wound channel. But the dense core of this projectile is not bonded to the sidewalls of the rear cavity. Rather, the dense core is pressure fit within the rear cavity. As a result, this projectile has been found to break apart when it hits heavy bones at or near muzzle velocity. Failure has been found to develop at the bulge portion. When the projectile breaks apart, the dense core is separated from the jacket, thereby undermining overall performance. In addition, because many dense cores contain lead, it is generally desired that the integrity of the projectile be maintained to prevent (or at least reduce) contamination of animal tissue due to lead exposure.

SUMMARY

In one exemplary embodiment, a projectile generally includes a jacket with nose, middle, and heel portions. The nose portion includes a forward cavity. The heel portion includes a rearward cavity having sidewalls. A dense core is within the rearward cavity and bonded to the sidewalls. Upon upset of the projectile, the portion of the jacket forming the forward cavity peels generally back toward the heel portion thereby forming petals, and the sidewalls and the dense core axially compress and radially expand to define a bulge portion, with the jacket material substantially covering the dense core material thereby inhibiting exposure of the dense core material to the upset media.

In another exemplary embodiment, a jacketed projectile upset generally includes a dense core material and a jacket material. The upset configuration includes a body having a mushroomed head and a bulge portion disposed rearward of the mushroomed head, and a plurality of jacket petals folded generally back from the body behind the mushroomed head. The dense core material is substantially covered by the jacket material thereby inhibiting exposure of the dense core material to the upset media.

Other aspects of the present disclosure relate to methods of using projections and methods of fabricating projectiles. One exemplary embodiment includes a method of using a projectile having a jacket including nose, middle, and heel portions, the nose portion including a forward cavity, the heel portion including a rearward cavity having sidewalls, and a dense core within the rearward cavity and bonded to the sidewalls. In this exemplary embodiment, the method generally includes upsetting the projectile by impacting the projectile with an object such that the portion of the jacket forming the forward cavity peels generally back toward the heel portion thereby forming petals, the sidewalls and the dense core axially compress and radially expand to define a bulge portion, with the jacket material substantially covering the dense core material thereby inhibiting exposure of the dense core material to the object.

Another exemplary embodiment includes a method of fabricating a projectile having a jacket including nose, middle, and heel portions, the nose portion including a forward cavity, the heel portion including a rearward cavity having sidewalls, and a dense core within the rearward cavity. In this exemplary embodiment, the method generally includes bonding the dense core to the sidewalls of the rearward cavity and softening the jacket adjacent the rearward cavity, the bonding and softening sufficient to allow the sidewalls and the dense core to axially compress and radially expand and form a bulge portion without rupturing the rearward cavity, with the jacket material substantially covering the dense core material for inhibiting exposure of the dense core material to the upset media.

Further aspects and features of the present disclosure will become apparent from the detailed description provided hereinafter. In addition, any one or more aspects of the present disclosure may be implemented individually or in any combination with any one or more of the other aspects of the present disclosure. It should be understood that the detailed description and specific examples, while indicating exemplary embodiments of the present disclosure, are intended for purposes of illustration only and are not intended to limit the scope of the present disclosure.

DRAWINGS

The drawings described herein are for illustration purposes only and are not intended to limit the scope of the present disclosure in any way.

Figure 7A:
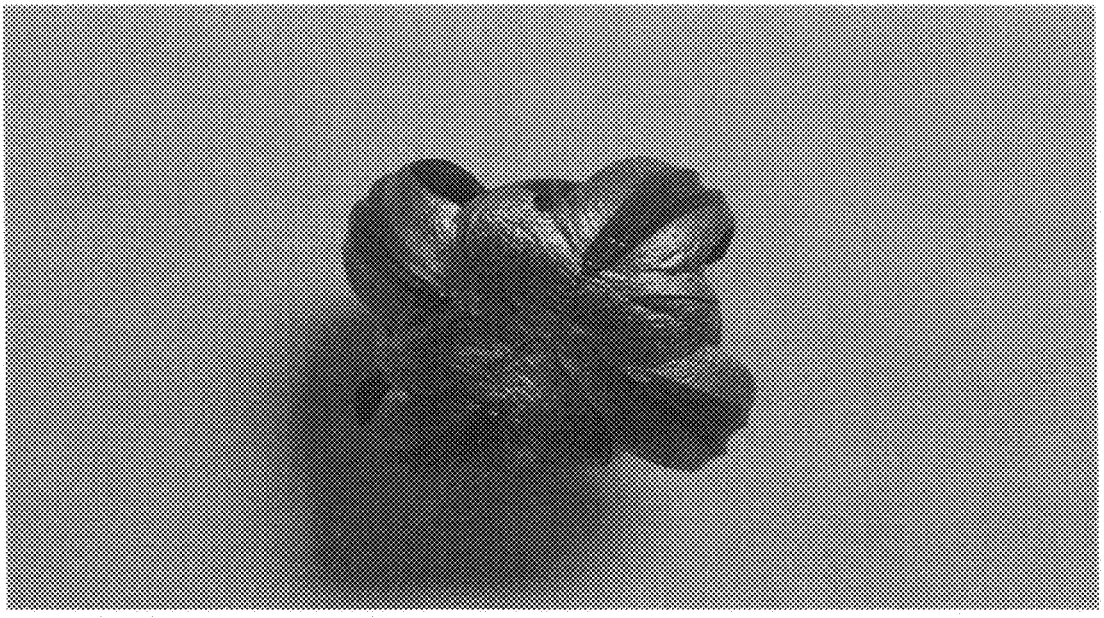
Figure 7B:
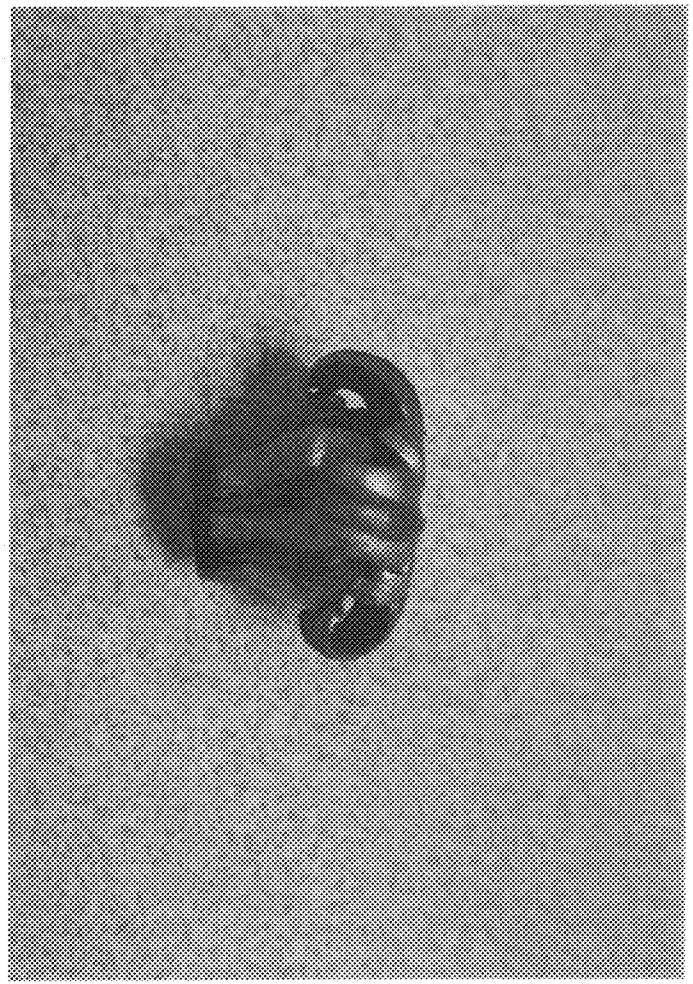
Figure 7C:
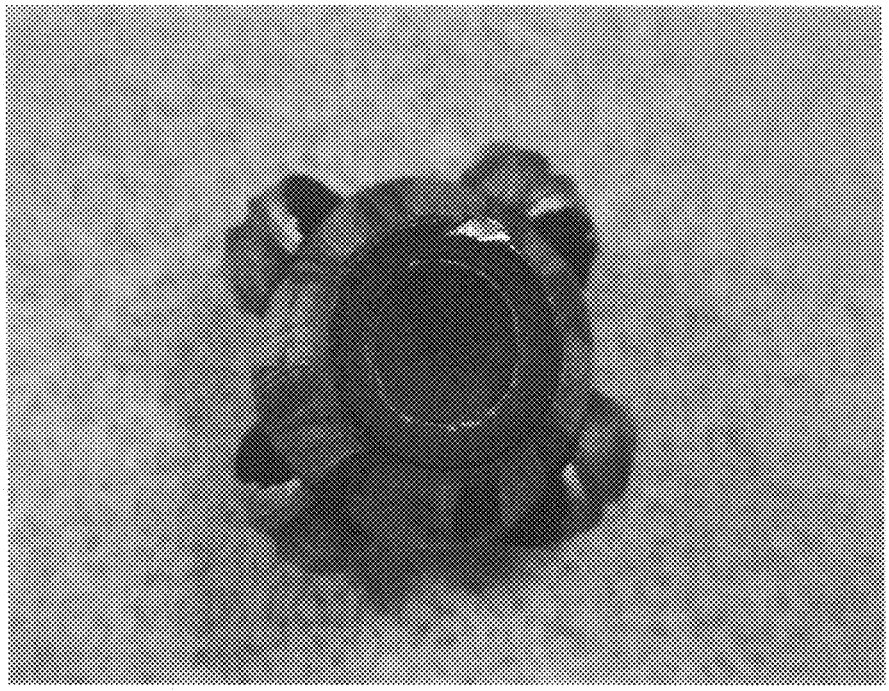
Figure 8A:
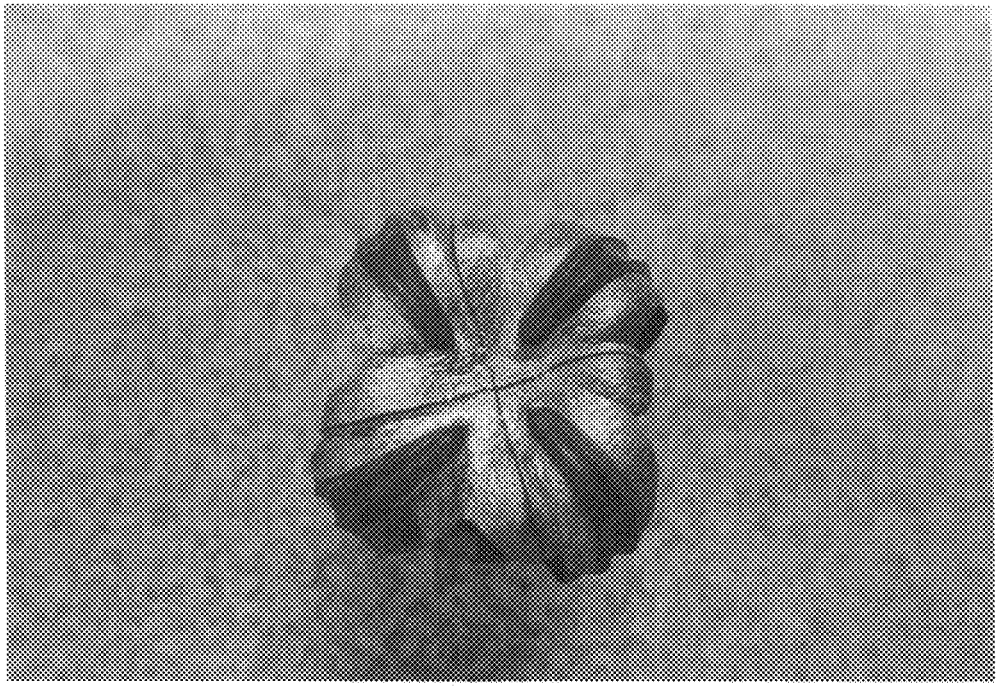
Figure 8B:
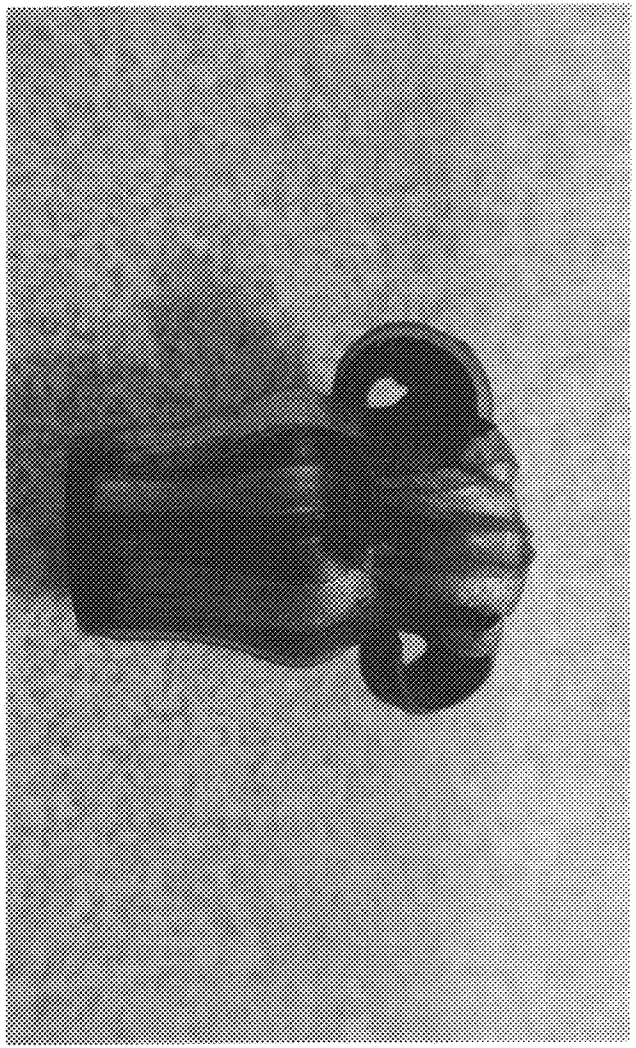
Figure 8C:
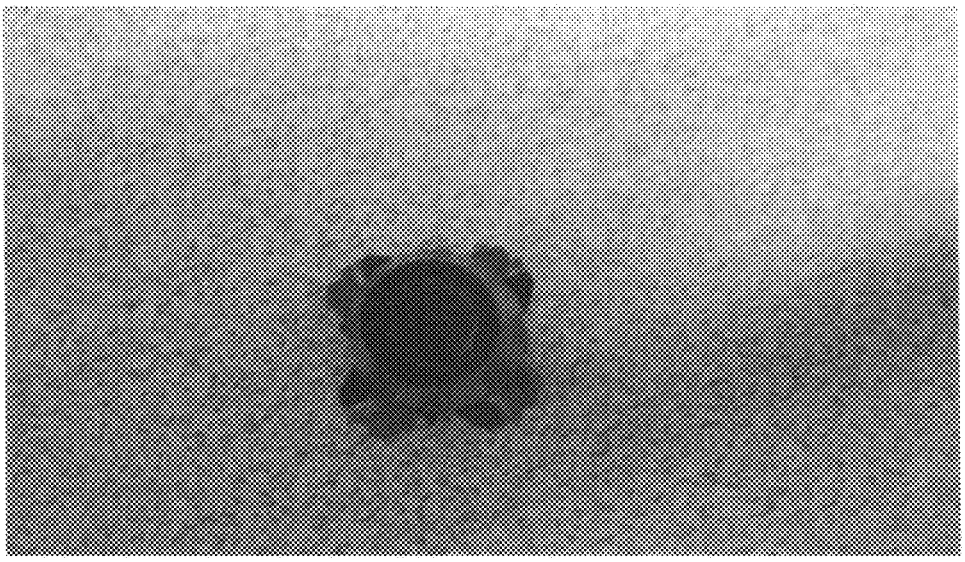

FIGS. 7A, 7B, and 7C are photographs taken respectively from the front, side, and rear of a jacketed projectile upset according to an exemplary embodiment after the projectile was fired and struck twenty percent gel at an impact velocity of about 2950 feet per second; and FIGS. 8A, 8B, and 8C are photographs taken respectively from the front, side, and rear of a jacketed projectile upset according to an exemplary embodiment after the projectile was fired and struck twenty percent gel at an impact velocity of about 2500 feet per second.

DETAILED DESCRIPTION

The following description is merely exemplary in nature and is in no way intended to limit the present disclosure, application, or uses.

According to various aspects, exemplary embodiments are provided of jacketed projectiles. Other aspects relate to embodiments of projectile upsets. Still further aspects relate to method of using projectiles and methods of fabricating projectiles.

In one exemplary embodiment, a projectile generally includes a jacket with nose, middle, and heel portions. The nose portion includes a forward cavity. The heel portion includes a rearward cavity having sidewalls. A dense core is within the rearward cavity and bonded to the sidewalls. Upon upset of the projectile, the portion of the jacket forming the forward cavity peels generally back toward the heel portion thereby forming petals, and the sidewalls and the dense core axially compress and radially expand to define a bulge portion, with the jacket material substantially covering the dense core material thereby inhibiting exposure of the dense core material to the upset media.

In another exemplary embodiment, a jacketed projectile upset generally includes a dense core material and a jacket material. The upset configuration includes a body having a mushroomed head and a bulge portion disposed rearward of the mushroomed head, and a plurality of jacket petals folded generally back from the body behind the mushroomed head. The dense core material is substantially covered by the jacket material thereby inhibiting exposure of the dense core material to the upset media.

Other aspects of the present disclosure relate to methods of using projectiles and methods of fabricating projectiles. One exemplary embodiment includes a method of using a projectile having a jacket including nose, middle, and heel portions, the nose portion including a forward cavity, the heel portion including a rearward cavity having sidewalls, and a dense core within the rearward cavity and bonded to the sidewalls. In this exemplary embodiment, the method generally includes upsetting the projectile by impacting the projectile with an object such that the portion of the jacket forming the forward cavity peels generally back toward the heel portion thereby forming petals, the sidewalls and the dense core axially compress and radially expand to define a bulge portion, with the jacket material substantially covering the dense core material thereby inhibiting exposure of the dense core material to the object.

Another exemplary embodiment includes a method of fabricating a projectile having a jacket including nose, middle, and heel portions, the nose portion including a forward cavity, the heel portion including a rearward cavity having sidewalls, and a dense core within the rearward cavity. In this exemplary embodiment, the method generally includes bonding the dense core to the sidewalls of the rearward cavity and softening the jacket adjacent the rearward cavity, the bonding and softening sufficient to allow the sidewalls and the dense core to axially compress and radially expand and form a bulge portion without rupturing the rearward cavity, with the jacket material substantially covering the dense core material for inhibiting exposure of the dense core material to the upset media.

As used herein, the term "projectile" generally refers to and includes any of a wide range of projectiles for use with any type of gun (e.g., rifles, handgun, shotguns, artillery, industrial ballistic tools, etc.) and various ammunition types (e.g., centerfire, rimfire, muzzleloader ammunition, etc.). By way of example only, the term "projectile" includes bullets, shells, explosive-filled projectiles, shots, non-explosive projectiles, hollow point bullets, etc.

In addition, the projectiles disclosed herein can be provided in different calibers having a variety of grain weights. By way of example only, the table below lists examples of popular game calibers in a variety of grain weights in which one or more of the projectiles disclosed herein can be provided.

| CALIBERS | GRAIN WEIGHTS |
|---|---|
| 30-06 | 150 grain and 180 grain |
| 300 Winchester Short Magnum | 150 grain and 180 grain |
| 300 Winchester Magnum | 150 grain and 180 grain |

-continued

| CALIBERS | GRAIN WEIGHTS |
|---|---|
| 308 Winchester | 150 grain |
| 7 millimeter Remington Magnum | 160 grain |
| 7 millimeter Winchester Short Magnum | 160 grain |
| 270 Winchester | 150 grain |
| 270 Winchester Short Magnum | 150 grain |

Figure 1:
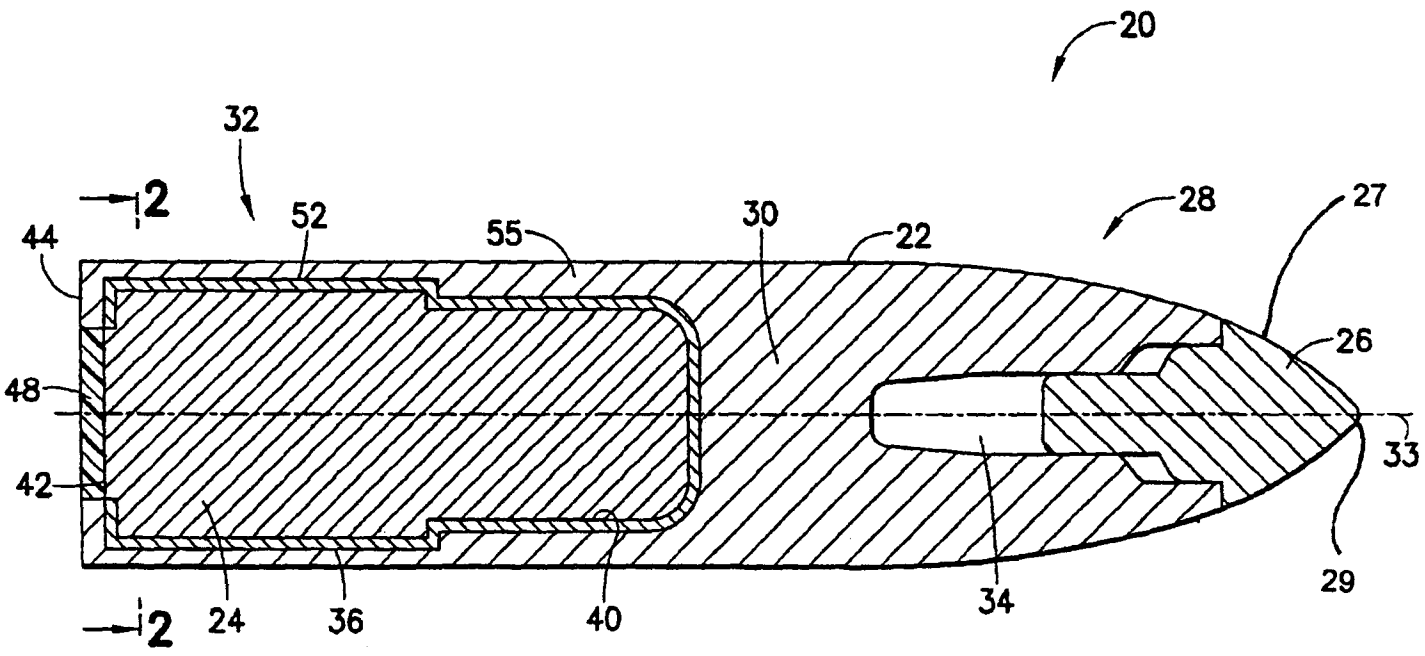
FIG. 1 is a longitudinal cross-sectional view of a controlled expansion projectile according to an exemplary embodiment.

FIG. 1 illustrates an exemplary controlled expansion projectile 20 embodying one or more aspects of the present disclosure. As shown in FIG. 1, the projectile 20 includes a jacket or body 22, a rear core 24, and a tip or nose element 26.

The jacket 22 includes a nose portion 28, a middle portion 30, and a heel portion 32. The jacket 22 is shown as a substantially cylindrical body formed around a longitudinal axis 33. The jacket 22 is generally formed of a unitary construction having an H-shaped cross section, such as that disclosed in U.S. Pat. No. 3,003,420. The jacket 22 can be fabricated from a copper alloy, as disclosed in U.S. Pat. No. 5,385,101. These U.S. Pat. Nos. 3,003,420 and 5,385,101 are incorporated by reference as if disclosed herein in their entirety.

In one exemplary embodiment, the jacket 22 is fabricated from brass, such as Copper Development Association (CDA of New York, N.Y.) 210 (nominal composition by weight 95% copper and 5% zinc). In other embodiments, the jacket 22 can be fabricated from other copper-zinc alloys, CDA 220, CDA 226, or copper alloy CDA 210. In still other embodiments, the jacket 22 may be fabricated from pure CDA 100 series metal. Alternative materials and/or other configurations may be used for the jacket 22. For example, some embodiments include a multi-piece construction for the jacket 22 and/or a non-metallic material for the jacket 22.

The jacket's nose portion 28 includes a forward cavity 34 disposed generally at the front of the nose portion 28. The jacket's heel portion 32 includes a rearward cavity 36 defined by sidewalls 40 generally at the rear of the heel portion 32. Accordingly, the forward and rearward cavities 34 and 36 may also be respectively referred to herein as front and rear cavities 34 and 36 for this illustrated embodiment. Alternatively, other embodiments may include a jacket defining additional cavities, such as one or more cavities either in front of the forward cavity 34 or behind the rear cavity 36.

With continued reference to FIG. 1, the jacket's heel portion 32 includes an open end 42 and a heel 44. The nose portion 28 and heel portion 32 are joined to one another via a middle portion 30. The middle portion 30 can be formed from a solid layer of the same material(s) used to form jacket 22. Alternative embodiments can include a middle portion 30 formed from a different material than that used for the other portions of the jacket 22. In either case, the middle portion 30 can accordingly serve as a partition between the forward or forward cavity 34 and the rear or rearward cavity 36.

In various embodiments, the dense core 24 is formed from lead. In other embodiments, the dense core 24 is formed from a lead-base alloy (e.g., an alloy including 2.5% antimony), lead compounds, or other heavy metals, such as a material disclosed in U.S. Pat. No. 5,127,332, which is hereby incorporated by reference as if disclosed herein in its entirety. In further embodiments, the dense core 24 may be formed from a lead-antimony alloy. Alternate materials may also be used, such as when low/non toxicity lead-free projectiles are required. In such alternative embodiments, other exemplary materials include bismuth, metal-filled polymers (e.g., tungsten-filled Nylon, etc.), and metal matrix composites (e.g., formed by various powder metallurgical or other techniques). The particular material(s) used for the dense core 24 can depend, for example, on the projectile geometry, upset tendencies, and/or on desired performance characteristics.

In various embodiments, the dense core 24 may be enclosed in the rearward cavity 36 using a closure disc 48 joined with the heel 44 to seal the open end 42. For example, the dense core 24 may be enclosed within the rearward cavity 36 by way of a closure disc 48 in a similar manner as disclosed in U.S. Pat. No. 5,333,552, which is hereby incorporated by reference as if disclosed herein in its entirety. Alternative embodiments include a unitary jacket having a closed heel formed generally around the dense core 24, thereby enclosing the dense core within rearward cavity 36.

In various embodiments, the projectile 20 includes means for increasing the ballistic coefficient. For example, and as shown in FIG. 1, the projectile 20 includes a tip 26 configured for increasing the ballistic coefficient. Additionally, or alternatively, the tip 26 can be configured for providing one or more performance improvements.

With continued reference to FIG. 1, the tip 26 is at least partially positioned in the forward cavity 34. The tip 26 can be made from a polycarbonate or polypropylene material. The tip 26 includes an ogival distal section 27 terminating in a point 29 at the distal end thereof. This ogival-shaped section 27 can increase the projectile's ballistic coefficient and improve down range performance. Inclusion of the tip 26 decreases the meplat size of the projectile 20 and helps lower the overall form factor (i) of the projectile 20, thereby increasing the ballistic coefficient (C) ($C=w/id^2$, where d is the diameter of the projectile, and w is the weight of the projectile). An increase in the ballistic coefficient increases downrange velocity, which in turn decreases the size of the velocity window for which the projectile must upset. This can be beneficial by increasing the overall performance of the projectile over a larger range of distances from the barrel muzzle since the projectile is more aerodynamic and loses speed at a slower rate.

Alternative materials may be used for tip 26, and/or the tip 26 may be integral to the jacket 22. Other than the portion of the tip 26, the forward cavity 34 is preferably empty. In alternative embodiments, the forward cavity 34 may not be empty. In these alternative embodiments, the material(s) within the forward cavity 34 are preferably less dense than the material(s) forming the dense core 24.

Figure 4:
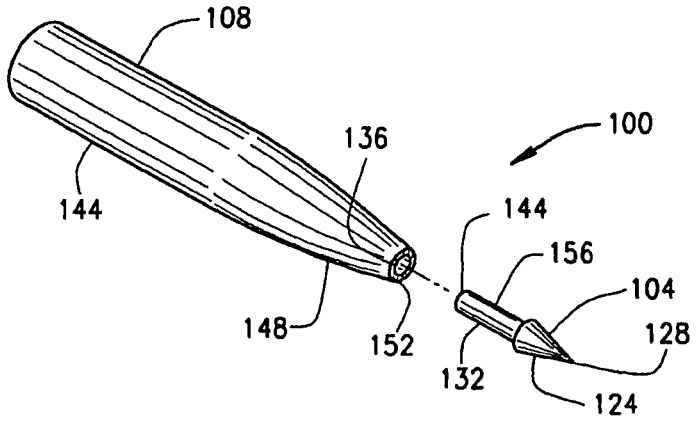
FIG. 4 is an exploded frontal perspective of a projectile illustrating a tip exploded away from the projectile body according to an exemplary embodiment.
Figure 5:
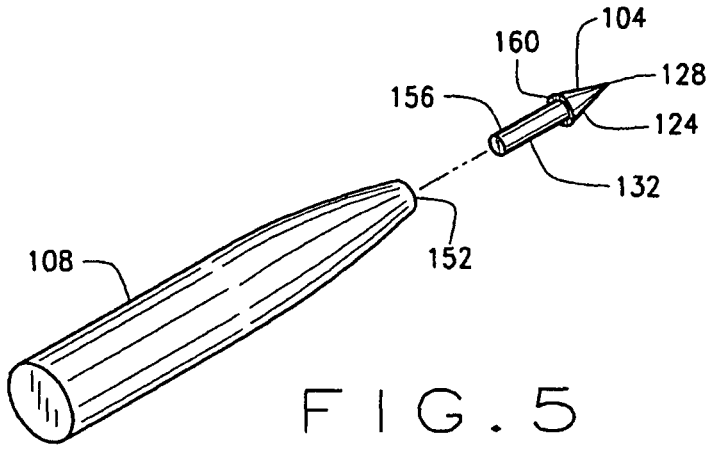
FIG. 5 is an exploded rearward perspective view of the projectile shown in FIG. 4.
Figure 6:
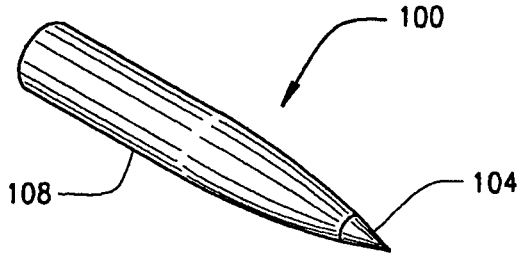
FIG. 6 is a perspective view of the projectile shown in FIG. 4.

FIGS. 4 through 6 illustrate another projectile 100 having a nose element or tip 104 disposed at a distal end portion of the projectile's body 108. As before with tip 26, the nose element 104 may be configured to provide one or more performance improvements, In this embodiment, the nose element 104 includes an ogival distal section 124 terminating in a point 128 at the distal end thereof. This ogival-shaped section 124 can increase the ballistic coefficient of the projectile 100 and improve down range performance.

The sharpness and/or type of ogival shape defined by the nose element 104 (or tip 26) can vary depending, for example, on the particular type of ammunition. By way of example only, the nose element 104 may include an ogival distal section 124 having a sharpness value ranging from about four to about ten, such as when the nose element 104 is configured for use with rifle ammunition. As other examples, the nose element 104 may include an elliptical or secant ogival distal section 124, such as when the nose element 104 is configured for use with pistol ammunition. Alternatively, the nose element 104 may be configured such that it defines an ogival distal section having a different sharpness value (e.g., less than four, greater than ten, etc.) and/or having a different type of ogive (e.g., spitzer, etc.). By way of further example, some embodiments include nose elements and tips having a relatively flat forward portion (e.g., wadcutters, semi-wadcutters, etc.) and/or a rounded nose configuration.

As shown in FIGS. 5 and 6, the projectile body 108 includes a generally cylindrical proximal portion 144 and an ogival distal portion 148 terminating at a distal rim 152. The distal-facing aperture 136 extends inwardly from the distal rim 152 into the body 108. In this particular embodiment, the distal-facing aperture 136 comprises a longitudinally extending cylindrical passage having a uniform circular cross-section. Alternatively, other types of apertures and/or passages having different cross-sectional shapes can be used in other embodiments.

The proximal section 132 of the nose element 104 comprises a generally cylindrical shaft or shank 156 having a uniform circular cross-section. Alternatively, other cross-sectional shapes can also be used for the shaft 156.

The shaft 156 is configured to engagingly interfit within the passage 136 into the projectile body 108. In various embodiments, the shaft 156 is dimensionally sized slightly larger than the cavity 136 extending into the projectile body 108. In such embodiments, the shaft 156 can then be press fit into the cavity 136 to thereby attach the nose element 104 to the projectile body 108. By way of example only, the shaft 156 may have an outer diameter that is about five-thousandths of an inch larger than the diameter of the cavity 136. Alternative means for attaching the nose element 104 to the projectile body 108 can be employed, such as mechanical crimping, adhesive bonding, chemical bonding, threading, resilient ribs, combinations thereof, etc. In addition, other embodiments can include a nose element or tip without any shaft or shank configured to engagingly interfit within an aperture or cavity of the projectile body. In such alternative embodiments, the nose element or tip can be bonded (e.g., adhesively bonded, etc.) to a forward portion of the projectile body without inserting any portion of the nose element or tip into the projectile body.

With continued reference to FIG. 5, the nose element 104 includes a proximal-facing shoulder 160 intermediate the proximal and distal ends of the nose element 104. When the shaft 156 is fully engaged or inserted into the passage 136, the shoulder 160 substantially abuts against the distal rim 152 of the projectile body 108. This abutting contact can help create a relatively smooth transition from the nose element 104 to the projectile body 108, which, in turn, can enhance the ballistic coefficient of the projectile 100.

In this particular embodiment, the entire nose element 104 is integrally or monolithically formed (e.g., via injection molding, etc.) from polycarbonate. In alternative embodiments, the proximal section 132 and ogival distal section 124 of the nose element 104 may be formed from different materials and/or different manufacturing processes.

Furthermore, the projectile body can also be provided or coated with an oxide lubricant, for example, to help reduce barrel fouling, pressure, and friction between projectile body and bore of gun barrel, improving accuracy over long shooting sessions, providing longer barrel life, and/or easier barrel cleaning. In one exemplary embodiment, the projectile body 108 is provided or coated with Lubalox® oxide lubricant.

Figure 2A:
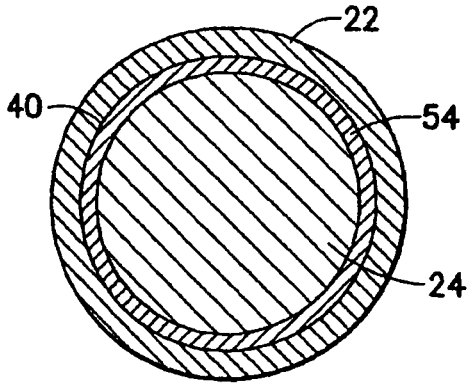
FIG. 2A is a cross-sectional view taken along line 2-2 of FIG. 1 of a controlled expansion projectile having a metallurgical bond according to an exemplary embodiment.

With reference back to FIG. 1, the dense core 24 is joined with the sidewalls 40, thereby forming a bond 52. This bond 52 helps prevent (or at least inhibit) the dense core 24 from separating from jacket 22 when the projectile 20 strikes an object. Referring to the exemplary embodiment shown in FIG. 2A, the bond 52 may be a metallurgical bond 54 formed between the sidewalls 40 and the dense core 24. In this particular example, the metallurgical bond 54 is formed during a process in which the dense core 24 is brought to a molten state such that after cooling a metallurgical bond 54 is formed between the dense core 24 to the sidewalls 40. This metallurgical bonding process can also serve to soften the jacket 22 adjacent the rearward cavity 36 along a thickened area 55 of the sidewalls 40 through annealing.

Figure 2B:
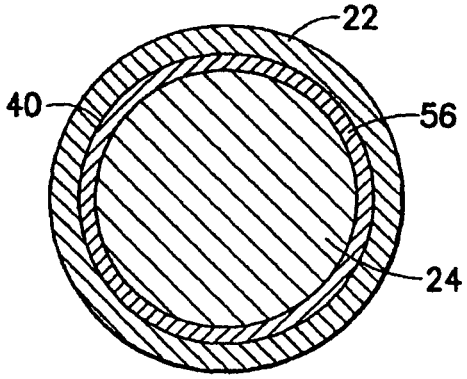
FIG. 2B is a cross-sectional view taken along line 2-2 of FIG. 1 of a controlled expansion projectile having a mechanical bond according to an exemplary embodiment.

Another exemplary embodiment is shown in FIG. 2B. In this particular embodiment, the bond 52 may be a mechanical bond 56 between the sidewalls 40 and the dense core 24. Examples of mechanical bonds include crimps, stakes, reverse tapers, interfering surface finishes, threads, combinations thereof, among other suitable and/or similar methods.

Figure 2C:
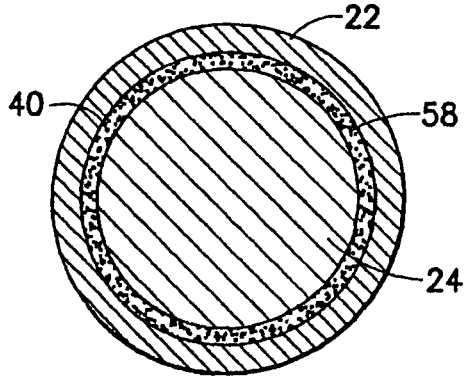
FIG. 2C is a cross-sectional view taken along line 2-2 of FIG. 1 of a controlled expansion projectile having an adhesive bond according to an exemplary embodiment.

FIG. 2C illustrates an exemplary embodiment in which the bond 52 may be an adhesive bond 58 between the sidewalls 40 and the dense core 24. Various adhesives can be utilized to form the adhesive bond 58 between the dense core 24 and the sidewalls 40. Examples of adhesives include glues and epoxies.

In embodiments where the bond 52 is not a metallurgical bond, the jacket 22 adjacent the rearward cavity 36 may also be softened using an annealing process prior to forming the bond 52. For example, the jacket 22 adjacent the rearward cavity 36 may be softened using an annealing process prior to forming the mechanical bond 56 (FIG. 2B) between the dense core 24 and the sidewalls 40. As another example, the jacket 22 adjacent the rearward cavity 36 may be softened using an annealing process prior to forming the adhesive bond 58 (FIG. 2C) between the dense core 24 and the sidewalls 40.

Another aspect of the present disclosure relates to methods of fabricating projectiles, such as controlled expansion projectiles. In one exemplary embodiment, a method generally includes filling a rearward cavity 36 of a unitary jacket 22 with a dense core 24. For example, lead or other relatively dense materials may be used for the dense core, and accordingly fill the rearward cavity 36. The dense core 24 can then be bonded to the sidewalls 40 of the rearward cavity 36, thereby forming a bond 52 between the dense core and sidewalls. The bond 52 may be a metallurgical bond, a mechanical bond, an adhesive bond, combinations thereof, etc. As the dense core 24 is bonded to the sidewalls 40, a portion (e.g., thickened area 55) of the jacket 22 adjacent the rearward cavity 36 along the bond 52 is softened. A tip 26 may be inserted into the forward cavity 34. For embodiments where the bond 52 is not a metallurgical bond and depending on the material(s) used to form the jacket 22, an annealing process may be performed to soften the jacket 22 adjacent the rearward cavity 36 prior to forming the bond 52. In those embodiments in which a metallurgical bond is used, the metallurgical bonding can allow both bonding of the dense core 24 to the sidewalls 40 and annealing of the sidewalls 40 to be accomplished during the same operation. Optionally, the method may further include enclosing the dense core 24 within the rearward cavity 36 by joining the closure disc 48 to the heel 44 of the jacket 22. Closure disc 48 may be joined to the heel 44 using mechanical methods (e.g., crimping, etc.), adhesives, combinations thereof, etc. As another option, the dense core 24 may instead be enclosed within the rearward cavity 36 by utilizing an alternative jacket, which formed around the dense core 24.

Figure 3:
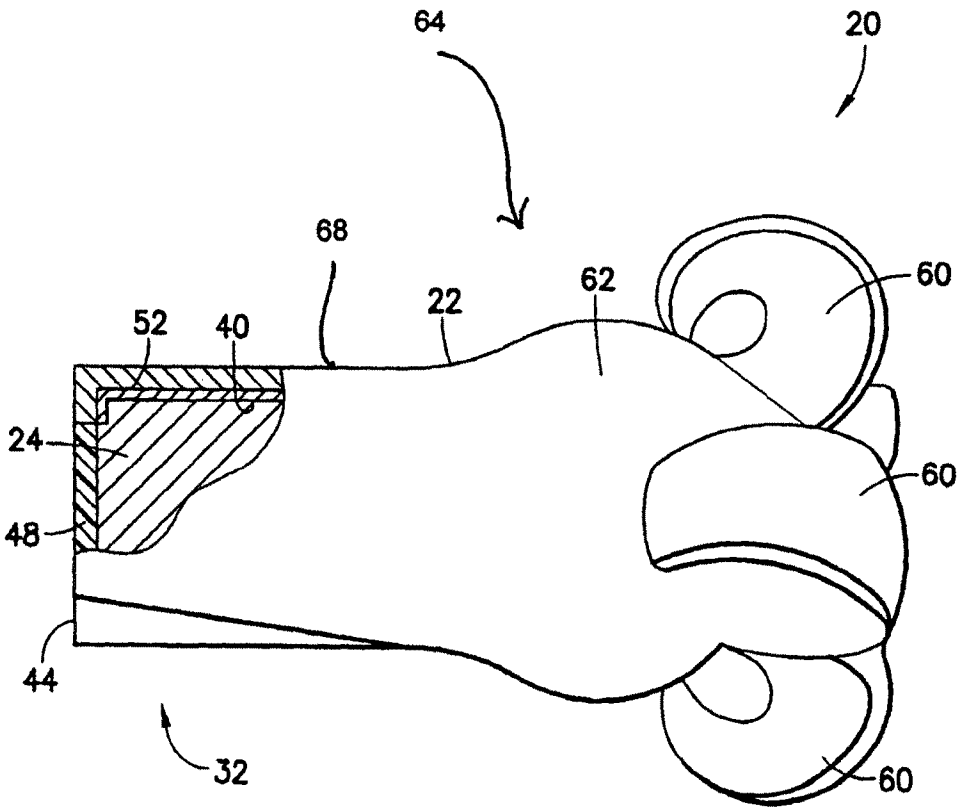
FIG. 3 is a side view in partial cross section of an exemplary upset configuration for the controlled expansion projectile shown in FIG. 1 after being fired and striking an object.

Referring now to FIG. 3, there is shown an exemplary upset configuration of a controlled expansion projectile (e.g., projectile 20, etc.). In this particular example, the upset configuration is the result from penetration into soft body tissue, which is simulated by penetration in ordinance gelatin.

As shown in FIG. 3, the upset projectile forms a mushroomed head 64 disposed distally or forwardly of the body portion 68 by the dense core 24 being forced forward during penetration and deceleration. As the mushroomed head 64 forms, the forward cavity 34 splits and peels back toward the heel portion 32, thereby forming petals 60. The sidewalls 40 and the dense core 24 accordion forward toward the petals 60 to define a bulge portion 62.

In various embodiments, the jacket material (e.g., brass, etc.) substantially covers and overlays the dense core material (e.g., lead, etc.). This can be advantageous in that the jacket material thus inhibits (and, in some cases, prevents) the dense core from being exposed to the upset media (e.g., gelatin, soft body tissue, etc.). With the dense core material covered by the jacket material, contamination of the upset media by the dense core material is accordingly prevented (or at least inhibited). In addition, the jacket material (or at least that portion covering the dense core material) provides protection to the dense core material from "washing," which would otherwise reduce the overall retained weight of the projectile.

The particular configuration (e.g., size, shape, location, etc.) of the petals 60, bulge portion 62, mushroomed head 64, and body portion 68 will depend on various factors. For example, the impact velocity, the upset media, and the particular projectile configuration (e.g., size, shape, location, materials used for the jacket 22 and the dense core 24, etc.) can affect the relative sizing, shape, and location of the upset configuration for a projectile.

In various embodiments, the bulge portion 62 provides at least some support and reinforcement to the petals 60. This reinforcement can help prevent (or at least inhibit) the petals 60 from tearing away from the projectile during impact. Accordingly, the projectile upset configuration shown in FIG. 3 includes relatively strong petals 60 that resist fragmentation, such as at relatively high impact velocities. In addition, the bond 52 (e.g., metallurgical bond 54, mechanical bond 56, adhesive bond 58, combinations thereof, etc.) between the sidewalls 40 and the dense core 24 can also help prevent (or at least inhibit) separation of the dense core 24 from the jacket 22, such as when the projectile impacts an object.

Projectiles embodying one or more aspects of the present disclosure can offer advantages over existing projectiles. For example, in some embodiments, a tip 26 is engaged with the forward cavity 34. The tip 26 and the forward cavity 34 are both distally disposed forward of the middle portion 30. The tip 26 and forward cavity 34 help initiate the upset or expansion of the projectile 20. After the tip 26 is expelled, the middle portion 30 (which can be formed from a solid layer of copper alloy or other similar material in some embodiments) is exposed to the upset media (e.g., body tissue, bone, skin, or other object the projectile strikes after being fired, etc.). As a result, the dense core 24 (which can contain lead or other heavy and dense metals in some embodiments) is not exposed to the upset media. This can help prevent (or at least inhibit) contamination of the upset media, and also protect the rear dense core from "washing", which would otherwise reduce the overall retained weight of the projectile.

The inclusion of the tip 26 or 104 can also be advantageous because the tip decreases the meplat size of the projectile, thereby leading to an increase in the projectile's ballistic coefficient and better downrange performance. An increase in the ballistic coefficient increases downrange velocity, which in turn decreases the size of the velocity window for which a projectile must upset. This can be beneficial by increasing the overall performance of a projectile over a larger range of distances from the barrel muzzle since the projectile is more aerodynamic and loses speed at a slower rate.

Bonding the dense core to the rearward cavity sidewalls can also provide one or more benefits over non-bonded projectile designs. For example, bonding can inhibit the bonded dense core from contacting the upset media, thereby inhibiting the dense core material from being washed off and contaminating the upset media. In addition, the bonding can also be beneficial when the projectile strikes a hard object (e.g., bone, etc.) and the jacket is ruptured. In such cases, the bonding between the rearward cavity sidewalls and the dense core can help minimize (or at least reduce) the escape of dense core pieces from the rearward cavity. Pieces of the dense core usually only escape the rearward cavity where entire pieces of the jacket and rearward cavity itself, are severed from the projectile. Because the dense core does not separate from the jacket, projectiles including a bonded dense core according to aspects of the present disclosure can have improved weight retention over non-bonded projectile designs.

Another benefit can be realized or attributed to the softened rearward cavity sidewalls of the jacket. In accordance with various aspects of the present disclosure, the inventors hereof have designed projectiles without emphasizing the elimination of the bulging tendencies of the rearward cavity in order to eliminate core jacket separation. Instead, the inventors hereof have designed projectiles so that the bulging tendencies are utilized in a positive way. As described herein, the sidewalls of the rearward cavity can be softened through annealing. The annealing may occur during a metallurgical bonding process through which the dense core is heated to a molten state and then cooled to form a metallurgical bond with the rearward cavity sidewalls. Or, for example, the annealing may comprise a separate process that is performed before the bonding (e.g., mechanical bonding, adhesive bonding, etc.) of the dense core to the rearward cavity sidewalls. With the annealing and softening of the rearward cavity sidewalls, the sidewalls are more malleable and less likely to rupture. Accordingly, the sidewalls can bulge outwardly and still remain intact. Even where the bulging sidewalls do rupture, the bonding of the dense core to the rearward cavity sidewalls can help ensure that little or no weight will be lost due to core jacket separation. The bulging portion at least partially supports and reinforces the front petals during upset to help ensure that the petals are not separated from the projectile. By keeping the petals attached, higher weight retention is achieved and a larger expanded diameter is possible. This, in turn, allows greater energy transfer from the projectile to its target by means of a larger wound channel.

Projectiles embodying aspects of the present disclosure can offer increased versatility. For example, a .308 caliber 150 grain bullet can be used in a 30 caliber cartridge with a muzzle velocity of approximately 2800 feet per second and in a much faster 30 caliber cartridge with a muzzle velocity of 3300 feet per second. The combination of an annealed jacket and bonded dense core allows a projectile to exhibit effective upset characteristics at a very wide range of impact velocities. The upsetting petals, in combination with the bulging portion, can exhibit the strength to be retained to the upsetting projectile at relatively high velocities. Plus, the plastic tip (or other suitable tip configuration) can also provide the requisite softness to facilitate expansion at low velocities.

The following table provides a comparison between a projectile with bonding of its dense core to its rearward cavity and another projectile that does not include such bonding. This table and the exemplary results therein are provided for purposes of illustration only, and not for purposes of limitation.

| TEST | PROJECTILE (without bonding of dense core to rearward cavity) | PROJECTILE (with bonding of dense core to rearward cavity) |
|---|---|---|
| At muzzle velocity as shot into 20% gelatin | | |
| Approximate Muzzle Velocity (feet per second) | 3300 | 3300 |
| Penetration (inches) | 27-30 | 16-19 |
| Expanded Diameter (inches) | .400-.450 | .700-.750 (190 percent or more of initial diameter) |
| Retained Weight (%) | 78-83 | 95-100 |
| At muzzle velocity as shot into cow bone and 20% gelatin | | |
| Approximate Muzzle Velocity (feet per second) | 3300 | 3300 |
| Penetration (inches) | 17-20 | 14-17 |
| Expanded Diameter (inches) | .475-.525 | .600-.650 (175 percent or more of initial diameter) |
| Retained Weight (%) | 70-75 | 78-83 |
| At 300 yard velocity as shot into 20% gelatin | | |
| Approximate 300 Yard Velocity (feet per second) | 2400 | 2500 |
| Penetration (inches) | 30-33 | 22-25 |
| Expanded Diameter (inches) | .400-.450 | .575-.625 (170 percent or more of initial diameter) |
| Retained Weight (%) | 78-83 | 95-100 |

The example results in the above table show that the projectile having a dense core bonded to a rearward cavity has a higher retained weight, an increased expanded diameter, and a decreased penetration, as compared to the other projectile that does not include the bonding. In addition, the decreased penetration is deemed acceptable because the amount of penetration is still sufficient for many applications, such as hunting.

FIGS. 7 and 8 are photographs illustrating exemplary upset configurations for a controlled expansion projectile at different impact velocities according to exemplary embodiments. More specifically, FIGS. 7A, 7B, and 7C are photographs illustrating an exemplary upset configuration for a controlled expansion projectile after being fired and striking twenty percent gel at an impact velocity of about 2950 feet per second. FIGS. 8A, 8B, and 8C are photographs illustrating an exemplary upset configuration for the controlled expansion projectile after being fired and striking twenty percent gel at an impact velocity at about 2500 feet per second, thus simulating a lower impact velocity (e.g., with less cartridge charge and/or after the bullet has traveled a longer range from the muzzle, etc.) than that shown in FIGS. 7A, 7B, an 7C. In FIGS. 7B and 8B, the unique appearance of the upset projectiles can be seen to include substantially brass petals coming into contact with the bulge portion of the upset projectile.

Accordingly, the inventors hereof have developed projectiles having unique terminal performance characteristics and appearances as compared to existing projectiles with non-bonded dense cores. As recognized by the inventors hereof, projectiles with non-bonded dense cores, after being upset in soft tissue, exhibit a mushroom shape in which the dense core is exposed to the upset media without any bulging portion supporting the frontal section of the petals. As disclosed herein, the inventors hereof have developed various controlled expansion projectiles having bonded dense cores (e.g., lead or other suitable dense materials). As further disclosed herein, a controlled expansion projectile can be configured such that, upon upset, the projectile includes include a bulge portion at least partially supporting and reinforcing jacket petals (e.g., brass or other suitable materials), and with the jacket material (e.g., brass or other material(s) used for the jacket) substantially covering the dense core material (e.g., lead or other material(s) used for the dense core). Accordingly, the jacket material inhibits exposure of the dense core material to the upset media. This, in turn, means the projectile will retain its weight (or lose very little weight) after upset, that is, unless the projectile loses an entire petal or petals (e.g., by fracturing or shearing off, etc.). By retaining more weight during upset, controlled expansion projectiles disclosed herein can retain more energy and penetrate deeper into the target. When weight is lost during upset of a projectile (a common occurrence for some existing projectile designs), the lost weight (e.g., lead, etc.) not only causes the upset projectile to lose energy and penetration, but the lost projectile material, such as lead, can also contaminate the upset media (e.g., game, such as deer, elk, etc.).

One or more exemplary benefits can also be realized by having an upset configuration that includes a bulge portion. For example, a bulge portion can at least partially support and reinforce the petals during the projectile's penetration, thereby reducing the likelihood of the petals shearing off. As another example, a bulge portion can also provide more frontal area to a projectile by keeping the petals "held-up" to achieve a larger footprint. A large frontal area assists in transferring energy to the target from the projectile. As a further example, radial expansion that produces the bulge portion can also impart energy and shock to the target. According to various aspects, the present disclosure relates to bonding of a projectile's dense core to rearward cavity sidewalls and jacket annealing, which can allow a projectile to bulge without rupturing the rearward cavity.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the methods and the steps, processes, and operations thereof described herein are not to be construed as necessarily requiring their performance in the particular order discussed or illustrated, unless specifically identified as an order or performance. It is also to be understood that additional or alternative steps may be employed.

The description of the disclosure is merely exemplary in nature and, thus, variations that do not depart from the gist of the disclosure are intended to be within the scope of the disclosure. Such variations are not to be regarded as a departure from the spirit and scope of the disclosure.

What is claimed is:

1. A projectile comprising a jacket including nose, middle, and heel portions, the nose portion including a forward cavity, the heel portion including a rearward cavity having sidewalls, and a dense core within the rearward cavity and bonded to the sidewalls, a tip at least partially positioned within the forward cavity, the projectile configured so that upon upset of the projectile, the portion of the jacket forming the forward cavity peels generally back toward the heel portion thereby forming petals, the sidewalls and the dense core axially compress and radially expand to define a bulge portion, with the jacket material substantially covering the dense core material thereby inhibiting exposure of the dense core material to the upset media.

2. A projectile comprising a jacket including nose, middle, and heel portions, the nose portion including a forward cavity, the heel portion including a rearward cavity having sidewalls, the jacket is softened adjacent the rearward cavity, and a dense core within the rearward cavity and bonded to the sidewalls, configured so that upon upset of the projectile, the portion of the jacket forming the forward cavity peels generally back toward the heel portion thereby forming petals, the sidewalls and the dense core axially compress and radially expand to define a bulge portion, with the jacket material substantially covering the dense core material thereby inhibiting exposure of the dense core material to the upset media.

* * * * *